US012338096B2

(12) United States Patent
Ueno et al.

(10) Patent No.: US 12,338,096 B2
(45) Date of Patent: Jun. 24, 2025

(54) SHEET POST-PROCESSING APPARATUS AND IMAGE FORMING SYSTEM INCLUDING THE APPARATUS

(71) Applicant: KYOCERA Document Solutions Inc., Osaka (JP)

(72) Inventors: Yasunori Ueno, Osaka (JP); Keisuke Egawa, Osaka (JP); Yusuke Takano, Osaka (JP); Takehiko Okada, Osaka (JP); Takuya Nishimura, Osaka (JP); Terumitsu Noso, Osaka (JP); Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 65 days.

(21) Appl. No.: 18/413,792

(22) Filed: Jan. 16, 2024

(65) Prior Publication Data

US 2024/0253938 A1 Aug. 1, 2024

(30) Foreign Application Priority Data

Jan. 24, 2023 (JP) ..... 2023-008751

(51) Int. Cl.
*B65H 31/38* (2006.01)
*B65H 31/02* (2006.01)
(Continued)

(52) U.S. Cl.
CPC ..... *B65H 31/38* (2013.01); *B65H 31/02* (2013.01); *B65H 31/34* (2013.01); *B65H 31/36* (2013.01);
(Continued)

(58) Field of Classification Search
None
See application file for complete search history.

(56) References Cited

U.S. PATENT DOCUMENTS 8,246,034 B2 * 8/2012 Tsuchiya ..... B65H 31/3018 270/58.11
8,820,734 B2 * 9/2014 Miyakawa ..... B65H 1/04 271/221
(Continued)

FOREIGN PATENT DOCUMENTS

JP H 04-169292 A 6/1992

*Primary Examiner* — Patrick Cicchino
(74) *Attorney, Agent, or Firm* — Stein IP, LLC

(57) ABSTRACT

Provided is a sheet post-processing apparatus in which a control portion repetitively performs a width-direction alignment operation including a first alignment operation of moving width regulating members from standby positions to first regulating positions after a sheet that is carried in onto a processing tray has been aligned in a carry-in direction by abutting of an edge of the sheet against a reference plate, and a second alignment operation of moving the width regulating members from the first regulating positions to the standby positions after performing the first alignment operation, and then moving the width regulating members to second regulating positions. The sheet post-processing apparatus satisfies C1>C2>P1≥C3 where P1 is a size in a width direction of the sheet, and C1, C2, and C3 are intervals between the width regulating members at the standby positions, the first regulating positions, and the second regulating positions, respectively.

9 Claims, 8 Drawing Sheets

(51) Int. Cl.

| | |
|---|---|
| ***B65H 31/34*** | (2006.01) |
| ***B65H 31/36*** | (2006.01) |
| ***B65H 31/40*** | (2006.01) |
| ***B65H 39/10*** | (2006.01) |

(52) U.S. Cl.
CPC ..... *B65H 31/40* (2013.01); *B65H 39/10* (2013.01); *B65H 2801/27* (2013.01)

(56) References Cited

U.S. PATENT DOCUMENTS

| | | | | |
|---|---|---|---|---|
| 9,840,391 | B2 * | 12/2017 | Taki | B65H 31/3018 |
| 2007/0013126 | A1 * | 1/2007 | Mizubata | B65H 31/34<br>271/238 |
| 2009/0014939 | A1 * | 1/2009 | Ichihashi | B65H 31/3027<br>271/3.02 |
| 2013/0341854 | A1 * | 12/2013 | Miyakawa | B65H 7/02<br>271/145 |

* cited by examiner

SHEET POST-PROCESSING APPARATUS AND IMAGE FORMING SYSTEM INCLUDING THE APPARATUS

INCORPORATION BY REFERENCE

This application is based on and claims the benefit of priority from Japanese Patent Application No. 2023-008751 filed on Jan. 24, 2023, the contents of which are hereby incorporated by reference.

BACKGROUND

The present disclosure relates to a sheet post-processing apparatus that executes predetermined post processes onto sheets on which images have been formed by an image forming apparatus, and to an image forming system including the sheet post-processing apparatus.

Known sheet post-processing apparatuses execute processes such as a binding process of stapling a bundle of a plurality of stacked sheets on which images have been formed by an image forming apparatus such as a copying machine or a printer, a punching process of forming punched holes (pierced holes) with use of a punching apparatus, and a folding process of forming creases in the sheets.

In such sheet post-processing apparatuses, a processing tray on which a predetermined number of the sheets with the images having been formed thereon are stacked is provided. Further, the processes such as the binding process and a shift discharge process (sorting process) are executed onto the plurality of sheets that have been stacked on the processing tray. Still further, in order that the processes such as the binding process and the shift discharge process are smoothly executed, the sheets on the processing tray are aligned in their width direction with use of a width regulating member.

SUMMARY

According to an aspect of the present disclosure, there is provided a sheet post-processing apparatus including: a conveying member; a processing tray; a processing unit; a reference plate; a pair of width regulating members; a drive unit; and a control portion.

The conveying member is configured to convey a sheet, the sheet including a plurality of sheets.

The plurality of sheets that are carried in along a predetermined carry-in direction by the conveying member are stacked on the processing tray.

The processing unit is configured to execute a predetermined post process onto the plurality of sheets that are stacked on the processing tray.

The reference plate is configured to align the plurality of sheets in the predetermined carry-in direction by abutting against edges of the plurality of sheets, the plurality of sheets being carried in onto the processing tray, the edges being on a downstream side in an alignment direction that is opposite to the predetermined carry-in direction.

The pair of width regulating members

- are configured to reciprocate in a width direction that is orthogonal to the predetermined carry-in direction, and
- are configured to align the plurality of sheets that are carried in onto the processing tray in the width direction.

The drive unit is configured to reciprocate the pair of width regulating members.

The control portion is configured to control the drive unit.

The control portion repetitively performs a width-direction alignment operation every time each of the plurality of sheets is carried in onto the processing tray, the width-direction alignment operation including

- a first alignment operation of moving the pair of width regulating members from standby positions to first regulating positions after each of the plurality of sheets that are carried in onto the processing tray has been aligned in the predetermined carry-in direction by the abutting of the edge of each of the plurality of sheets against the reference plate, and

- a second alignment operation of
  - moving the pair of width regulating members from the first regulating positions to the standby positions after performing the first alignment operation, and
  - then moving the pair of width regulating members to second regulating positions.

The sheet post-processing apparatus satisfies the following formula (1)

$$C1>C2>P1\geq C3 \quad (1)$$

where

- P1 is a size in the width direction of each of the plurality of sheets,
- C1 is an interval between the pair of width regulating members at the standby positions,
- C2 is an interval between the pair of width regulating members at the first regulating positions, and
- C3 is an interval between the pair of width regulating members at the second regulating positions.

DETAILED DESCRIPTION

[1. Configuration of Image Forming System]

Figure 1:
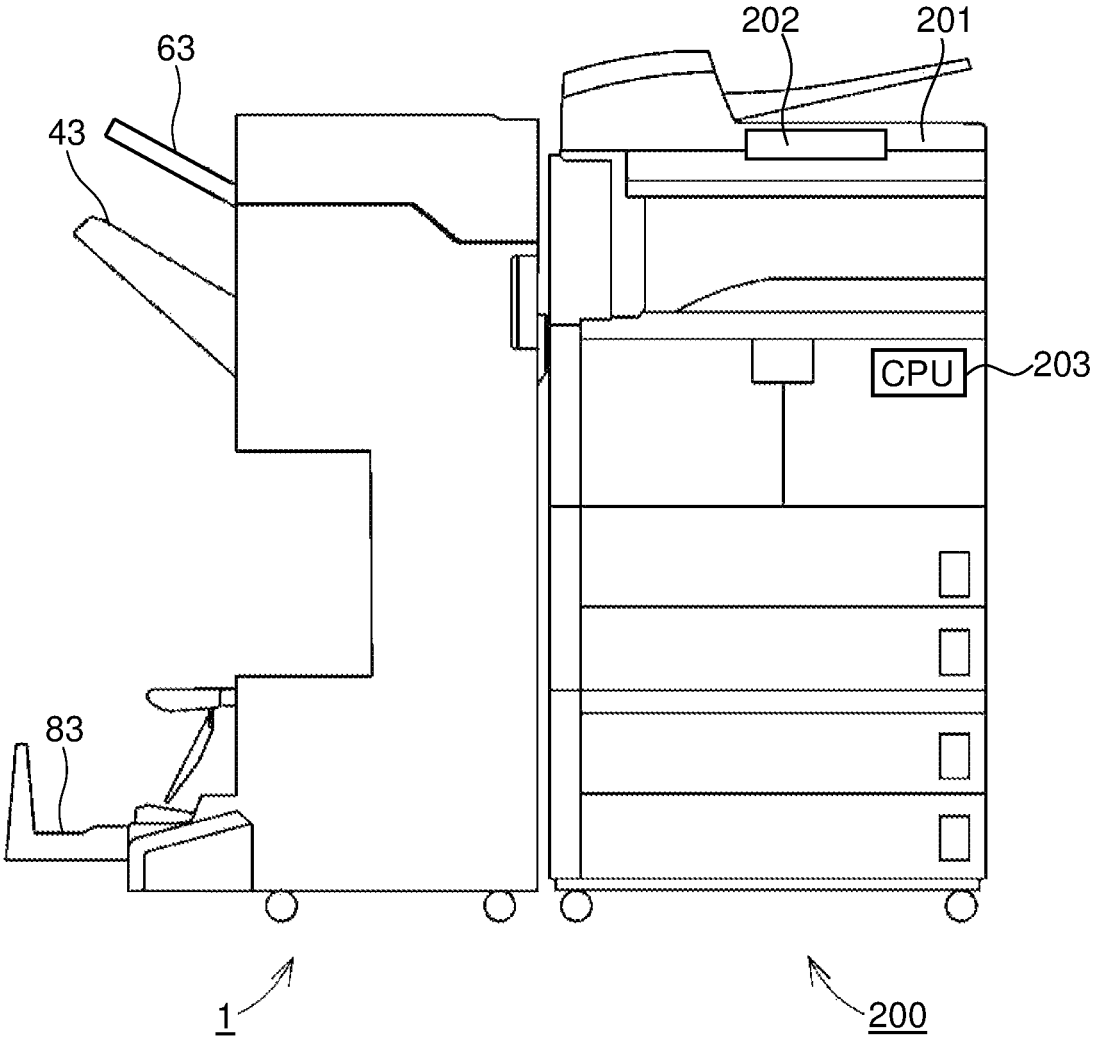
FIG. 1 is a schematic view illustrating a configuration of an image forming system that is constituted by a sheet post-processing apparatus according to an embodiment of the present disclosure, and by an image forming apparatus to which the sheet post-processing apparatus is joined.

Now, an embodiment of the present disclosure is described in detail with reference to the accompanying drawings. FIG. 1 is a schematic view illustrating a configuration of an image forming system that is constituted by a sheet post-processing apparatus 1 according to the embodiment of the present disclosure, and by an image forming apparatus 200 to which the sheet post-processing apparatus 1 is joined.

As illustrated in FIG. 1, the image forming apparatus 200 prints images onto sheets (paper) on the basis of image data input from an outside via a network communication unit (not shown), or of image data read by an image reading unit 201 arranged in an upper portion of the image forming apparatus 200. In this embodiment, the image forming apparatus 200 is an ink-jet recording apparatus including a recording head (not shown) corresponding to colors and having a large number of nozzle ports through which inks are ejected onto the sheets.

An operation panel 202 is arranged in the front of the image reading unit 201. The operation panel 202 is an operation unit for accepting various setting inputs. For example, a user can input size information of the sheets by operating the operation panel 202. In addition, by operating the operation panel 202, the user can also input the number of the sheets to be printed, and can issue an instruction to start a print job. A main body control portion 203 controls the units in the image forming apparatus 200 by coordinating operation of an entirety of the image forming apparatus 200.

The sheet post-processing apparatus 1 is joined to be removable to a side surface of the image forming apparatus 200. The sheet post-processing apparatus 1 executes post-processes such as a punching process and a binding process onto the sheets that have been subjected to image formation (printed) by the image forming apparatus 200. Note that, the sheet post-processing apparatus 1 need not necessarily execute the post-processes onto the sheets that are automatically conveyed from the image forming apparatus 200, and may execute the post-processes onto sheets that are set on a tray (not shown) by the user and then conveyed by the sheet post-processing apparatus 1 itself to a position where the post-processes can be executed.

[2. Configuration of Sheet Post-Processing Apparatus]

Figure 2:
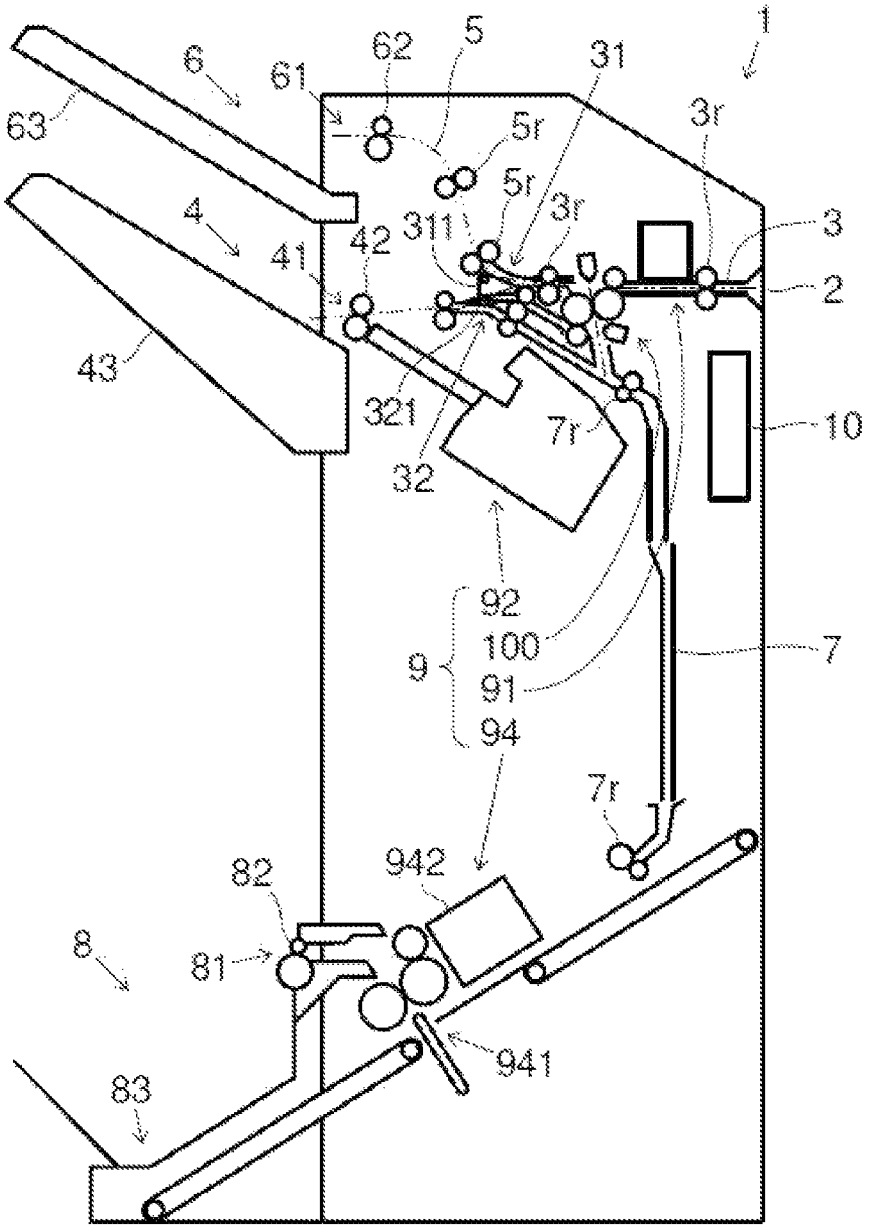
FIG. 2 is a schematic cross-sectional side view illustrating a configuration of the sheet post-processing apparatus according to the embodiment.

FIG. 2 is a schematic cross-sectional side view illustrating a configuration of the sheet post-processing apparatus 1 according to this embodiment. As illustrated in FIG. 2, the sheet post-processing apparatus 1 includes a sheet carry-in port 2, a first sheet-conveying path 3, a first sheet-discharge section 4, a second sheet-conveying path 5, a second sheet-discharge section 6, a third sheet-conveying path 7, a third sheet-discharge section 8, a post-processing section 9, and a post-processing control portion (control portion) 10.

The sheet carry-in port 2 is an opening that is provided in a side surface of the sheet post-processing apparatus 1, the side surface facing the image forming apparatus 200. The sheets conveyed from the image forming apparatus 200 to the sheet post-processing apparatus 1 are carried into the sheet post-processing apparatus 1 through the sheet carry-in port 2.

The first sheet-conveying path 3 extends from the sheet carry-in port 2 to the first sheet-discharge section 4 substantially horizontally in a direction away from the image forming apparatus 200 (left direction in FIG. 2). Note that, this direction from the sheet carry-in port 2 to the first sheet-discharge section 4 is referred to as a "sheet conveying direction of the first sheet-conveying path 3." The sheet carry-in port 2 is located at an upstream end in the sheet conveying direction of the first sheet-conveying path 3. The first sheet-conveying path 3 includes a plurality of conveying roller pairs 3*r*, which convey the sheets carried in the sheet post-processing apparatus 1 through the sheet carry-in port 2 toward a downstream side in the sheet conveying direction.

The first sheet-discharge section 4 is provided to other side surface of the sheet post-processing apparatus 1, the other side surface being on a side opposite to a side where the side surface facing the image forming apparatus 200 is present. The first sheet-discharge section 4 is arranged at a downstream end in the sheet conveying direction of the first sheet-conveying path 3. The first sheet-discharge section 4 includes a first discharge port 41, first discharge-roller pairs 42, and a first discharge tray 43.

The first discharge port 41 is located at the downstream end in the sheet conveying direction of the first sheet-conveying path 3. The first discharge-roller pairs 42 are arranged in the first discharge port 41. The first discharge tray 43 is located on a downstream side relative to the first discharge port 41 in the sheet conveying direction. The sheets that have been conveyed in the first sheet-conveying path 3 and reached the first discharge port 41 are discharged by the first discharge-roller pairs 42 onto the first discharge tray 43 through the first discharge port 41. The first discharge tray 43 is one of discharge destinations of the sheets that have been subjected to the post processes by the sheet post-processing apparatus 1.

The second sheet-conveying path 5 branches from a first branch portion (branch portion) 31 in the first sheet-conveying path 3, and extends to the second sheet-discharge section 6 laterally and upward in the direction away from the image forming apparatus 200 (left direction in FIG. 2). The first branch portion 31 is arranged on a downstream side relative to a piercing unit 91 in the sheet conveying direction of the first sheet-conveying path 3. Note that, a direction from the first branch portion 31 to the second sheet-discharge section 6 is referred to as a "sheet conveying direction of the second sheet-conveying path 5." The first branch portion 31 is located at an upstream end in the sheet conveying direction of the second sheet-conveying path 5. The second sheet-conveying path 5 includes a plurality of conveying roller pairs 5*r*, which cause the sheets that are conveyed in the first sheet-conveying path 3 to be diverted at the first branch portion 31, and to thereby be conveyed toward the second sheet-discharge section 6.

The first branch portion 31 includes a first switching guide 311. The first switching guide 311 turns to a position at which the sheets that are conveyed in the first sheet-conveying path 3 from a side where the sheet carry-in port 2 is present are guided to the first discharge port 41 along the first sheet-conveying path 3, and to a position at which the sheets are diverted from the first sheet-conveying path 3 and then guided to the second sheet-conveying path 5. In addition, the first switching guide 311 turns also to a position at which sheets that have been subjected to a folding process are guided to the second sheet-conveying path 5. The first switching guide 311 is connected to a drive mechanism (not shown), and operated under control by the post-processing control portion 10.

The second sheet-discharge section 6 is provided to the other side surface of the sheet post-processing apparatus 1, the other side surface being on the side opposite to the side where the side surface facing the image forming apparatus 200 is present, the second sheet-discharge section 6 being provided above the first sheet-discharge section 4. The second sheet-discharge section 6 is arranged at a downstream end in the sheet conveying direction of the second sheet-conveying path 5. The second sheet-discharge section 6 includes a second discharge port 61, a second discharge-roller pair 62, and a second discharge tray 63.

The second discharge port 61 is located at the downstream end in the sheet conveying direction of the second sheet-conveying path 5. The second discharge-roller pair 62 is arranged in the second discharge port 61. The second discharge tray 63 is located on a downstream side relative to the second discharge port 61 in the sheet conveying direction. The sheets that have been conveyed in the second sheet-conveying path 5 and reached the second discharge port 61 are discharged by the second discharge-roller pair 62 onto the second discharge tray 63 through the second discharge port 61. The second discharge tray 63 is another one of the discharge destinations of the sheets that have been subjected to the post processes by the sheet post-processing apparatus 1. In addition, sheets that are not subjected to the post-processes, sheets of small sizes, and the like are also discharged onto the second discharge tray 63.

The third sheet-conveying path 7 branches from a second branch portion 32 in the first sheet-conveying path 3, and extends downward to the third sheet-discharge section 8. Note that, a direction from the second branch portion 32 to the third sheet-discharge section 8 is referred to as a "sheet conveying direction of the third sheet-conveying path 7." The second branch portion 32 is located on a downstream side relative to the first branch portion 31 in the sheet conveying direction of the first sheet-conveying path 3, and located at an upstream end in the sheet conveying direction of the third sheet-conveying path 7. The third sheet-conveying path 7 includes a plurality of conveying roller pairs 7*r*, which cause the sheets that are conveyed in the first sheet-conveying path 3 to be diverted at the second branch portion 32, and to thereby be conveyed toward the third sheet-discharge section 8.

The second branch portion 32 includes a second switching guide 321. The second switching guide 321 turns to the position at which the sheets that are conveyed in the first sheet-conveying path 3 from the side where the sheet carry-in port 2 is present are guided to the first discharge port 41 along the first sheet-conveying path 3, and to a position at which sheets that have been conveyed in the first sheet-conveying path 3 from the side where the sheet carry-in port 2 is present, have passed through the second branch portion 32, and then have been switched back are guided to the third sheet-conveying path 7. The second switching guide 321 is connected to a drive mechanism (not shown), and operated under the control by the post-processing control portion 10.

The third sheet-discharge section 8 is provided to the other side surface of the sheet post-processing apparatus 1, the other side surface being on the side opposite to the side where the side surface facing the image forming apparatus 200 is present, the third sheet-discharge section 8 being provided below the first sheet-discharge section 4 (near a lower end portion of the sheet post-processing apparatus 1). The third sheet-discharge section 8 includes a third discharge port 81, a third discharge-roller pair 82, and a third discharge tray 83.

The third discharge port 81 is located at a downstream end in the sheet conveying direction of the third sheet-conveying path 7. The third discharge-roller pair 82 is arranged in the third discharge port 81. The third discharge tray 83 is located on a downstream side relative to the third discharge port 81 in the sheet conveying direction. The sheets that have been conveyed in the third sheet-conveying path 7 and reached the third discharge port 81 are discharged by the third discharge-roller pair 82 onto the third discharge tray 83 through the third discharge port 81. The third discharge tray 83 is a still another one of the discharge destinations of the sheets that have been subjected to the post processes by the sheet post-processing apparatus 1.

The post-processing section 9 executes the predetermined post-processes onto the sheets on which images have been formed by the image forming apparatus 200 and which then have been carried into the sheet post-processing apparatus 1. The post-processing section 9 includes the piercing unit 91, a sheet binding unit 92, a sheet folding unit 100, and a bookbinding unit 94.

The piercing unit 91 is arranged immediately on the downstream side relative to the sheet carry-in port 2 in the first sheet-conveying path 3. The piercing unit 91 executes a piercing process onto the sheets to be conveyed in the first sheet-conveying path 3. With this, punched holes are formed.

The sheet binding unit 92 is arranged immediately on an upstream side relative to the first sheet-discharge section 4 in the sheet conveying direction of the first sheet-conveying path 3. The sheet binding unit 92 executes a stapling process (binding process) onto sheets bundles formed by stacking a plurality of sheets. With this, the sheet bundles are bound. Details of a configuration of the sheet binding unit 92 are described below.

The sheet folding unit 100 is arranged on the downstream side relative to the piercing unit 91 and on an upstream side relative to the sheet binding unit 92 in the sheet conveying direction of the first sheet-conveying path 3. The sheet folding unit 100 executes the folding process onto each of the sheets. With this, a crease is formed. The sheet folding unit 100 is capable of executing folding processes such as bifold, Z-fold, six-page accordion fold, and inner trifold onto each of the sheets.

The bookbinding unit 94 is arranged immediately on an upstream side relative to the third sheet-discharge section 8 in the sheet conveying direction of the third sheet-conveying path 7. The bookbinding unit 94 includes a center folding portion 941 and a saddle stapling portion 942. The bookbinding unit 94 executes a center folding process and a saddle stapling process in which a substantially central portion in the sheet conveying direction of each of the sheet bundles formed by stacking the plurality of sheets is folded and bound. With this, booklets are formed.

The post-processing control portion (control portion) 10 includes a CPU, a storage unit, and other electronic circuits and electronic components (none of which is shown). The post-processing control portion 10 is connected to be communicable with the main body control portion 203 (refer to FIG. 1) of the image forming apparatus 200. In response to instructions from the main body control portion 203, the post-processing control portion 10 causes the CPU to control operations of the components provided in the sheet post-processing apparatus 1 on the basis of control programs and data stored in the storage unit. In this way, the post-processing control portion 10 executes processes relating to functions of the sheet post-processing apparatus 1. The first sheet-conveying path 3, the first sheet-discharge section 4, the second sheet-conveying path 5, the second sheet-discharge section 6, the third sheet-conveying path 7, the third sheet-discharge section 8, and the post-processing section 9 individually receive the instructions from the post-processing control portion 10, and execute the post processes in conjunction with each other. Note that, functions of the post-processing control portion 10 may be implemented also by the main body control portion 203 of the image forming apparatus 200.

[3. Configuration of Sheet Binding Unit]

Figure 3:
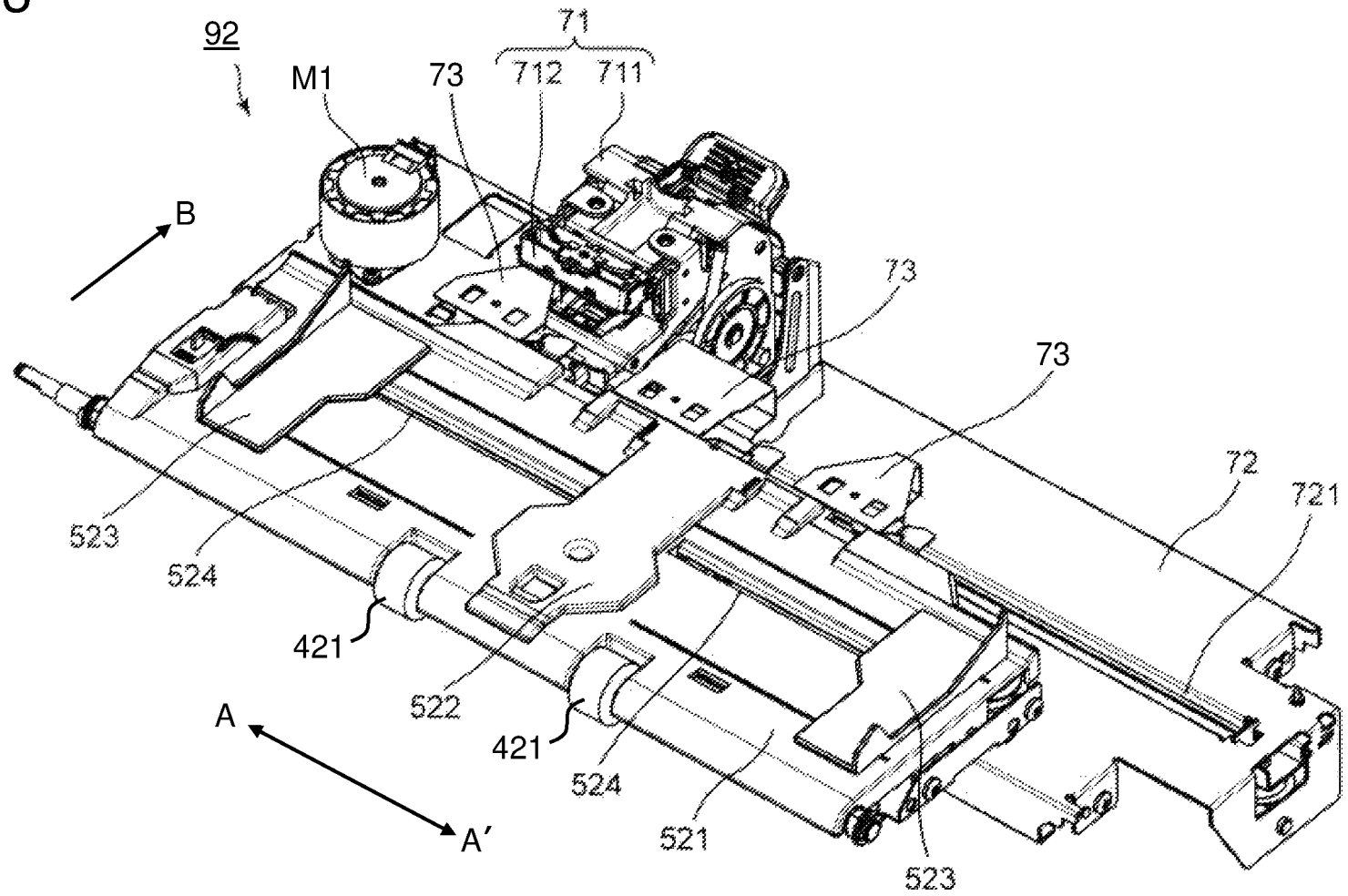
FIG. 3 is a perspective view of a sheet binding unit to be installed in the sheet post-processing apparatus according to the embodiment.
Figure 4:
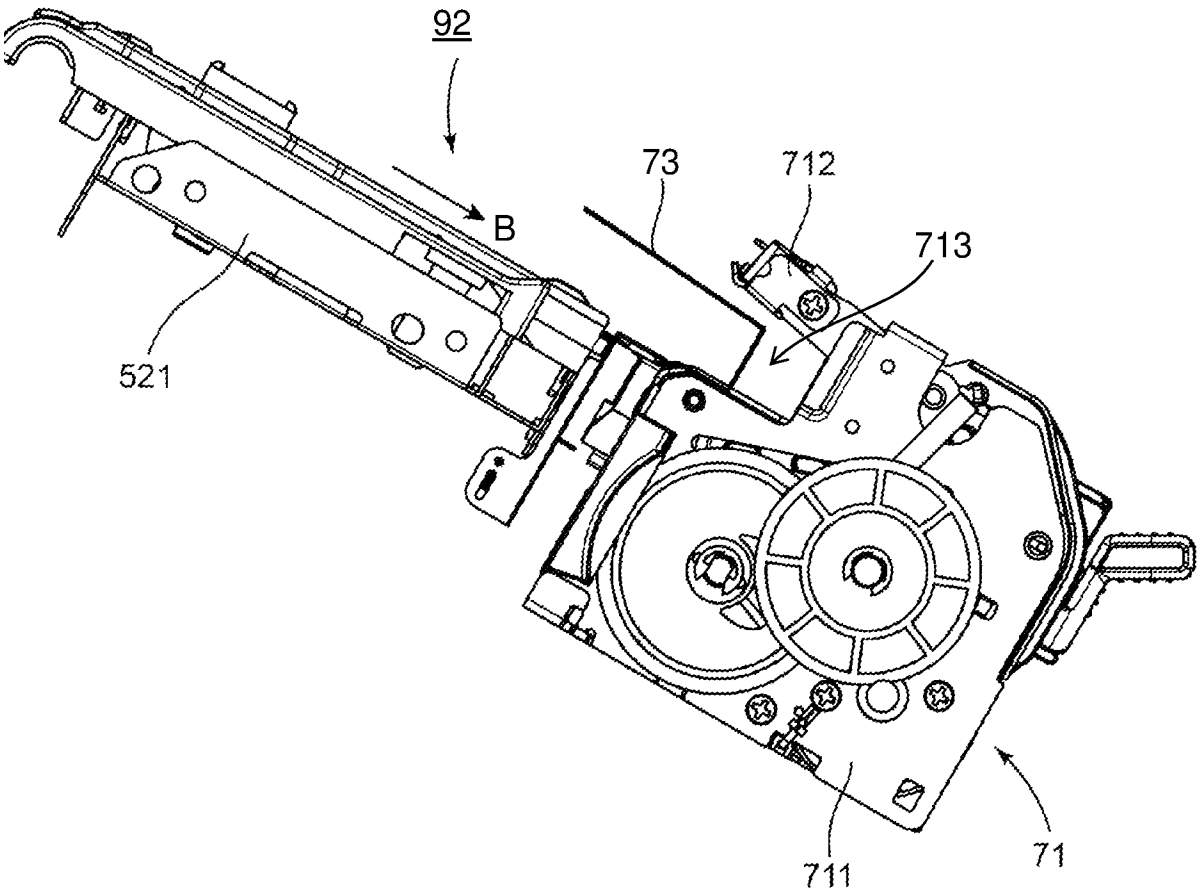
FIG. 4 is a side view of the sheet binding unit.

Next, a configuration of the sheet binding unit 92 is described. FIG. 3 is a perspective view of the sheet binding unit 92 to be installed in the sheet post-processing apparatus 1. FIG. 4 is a side view of the sheet binding unit 92.

As illustrated in FIG. 3, the sheet binding unit 92 includes a processing tray 521, a stapling unit 71, and reference plates 73.

The processing tray 521 is a rectangular tray that extends in a sheet width direction (directions of arrows A-A') and a carry-in direction. A plurality of sheets S (sheet bundle) to be subjected to the stapling process are stacked on the processing tray 521. At this time, the sheets S are carried in onto the processing tray 521 along an alignment direction (direction opposite to the carry-in direction) into the lower right direction in FIG. 4 (direction of an arrow B). The sheet bundle that has been subjected to the stapling process is lastly sent out into a direction opposite to the alignment direction (upper left direction in FIG. 4) by the first discharge-roller pairs 42 (refer to FIG. 2), thereby discharged onto the first discharge tray 43 (refer to FIG. 2). Discharge lower rollers 421 constituting the first discharge-roller pairs 42 is supported on a downstream side in the carry-in direction (lower left side in FIG. 3) of the processing tray 521.

The processing tray 521 includes a tray central portion 522 and width regulating members 523. The tray central portion 522 is arranged at a central portion in the sheet width direction on an upper surface portion of the processing tray 521. The tray central portion 522 is a thin-plate-like member that is fixed with a slight height onto the processing tray 521.

The width regulating members 523 are arranged in a pair in a manner that sandwiches the tray central portion 522 in the sheet width direction. The width regulating members 523 regulate positions in the sheet width direction of the sheets S to be carried in onto the processing tray 521. The width regulating members 523 are each formed of a thin-plate-like member similar to the tray central portion 522, and each have a side wall provided upward at their end portions in the sheet width direction. A guide groove 524 that extends in the sheet width direction is formed in the processing tray 521. The width regulating members 523 can be reciprocated along the guide groove 524 in the sheet width direction by a width-regulating-member drive motor M2 (refer to FIG. 6) and a drive mechanism such as a rack-and-pinion gear (not shown). In this embodiment, every time the sheets S are carried in onto the processing tray 521, the width regulating members 523 are reciprocated by the drive mechanism. As a result, the sheets S stacked on the processing tray 521 are aligned in the sheet width direction.

The stapling unit 71 is arranged to face edges of the sheets S on their leading side in the alignment direction (right side in FIG. 4). The stapling unit 71 is movable in the sheet width direction (directions of the arrows A-A') along the edges of the sheets S by driving force of a stapling-unit drive motor M1, the sheet width direction being orthogonal to the carry-in direction, and executes the stapling process onto the sheet bundles.

As illustrated in FIG. 4, the stapling unit 71 includes a stapling body portion 711 and a stapling movable portion 712. The stapling body portion 711 is a main part of the stapling unit 71, and stores a plurality of staples (not shown) therein. The stapling movable portion 712 is configured to be movable upward and downward, and staples the sheets S. A recessed portion 713 into which the edges of the sheets S advance is formed between the stapling body portion 711 and the stapling movable portion 712.

The reference plates 73 are fixed at three points at an interval in the sheet width direction to face an edge portion on a downstream side in the alignment direction of the processing tray 521 (upper right side in FIG. 3 and lower right side in FIG. 4). The reference plates 73 each have a substantially U-shape opened on an upstream side in the alignment direction (the upper left side in FIG. 4) in cross-sectional view orthogonal to the sheet width direction. The reference plates 73 align the sheets S to be carried in onto the processing tray 521 in the carry-in direction by abutting against the edges of these sheets S.

[4. Configuration Around Processing Tray of Sheet Binding Unit]

Figure 5:
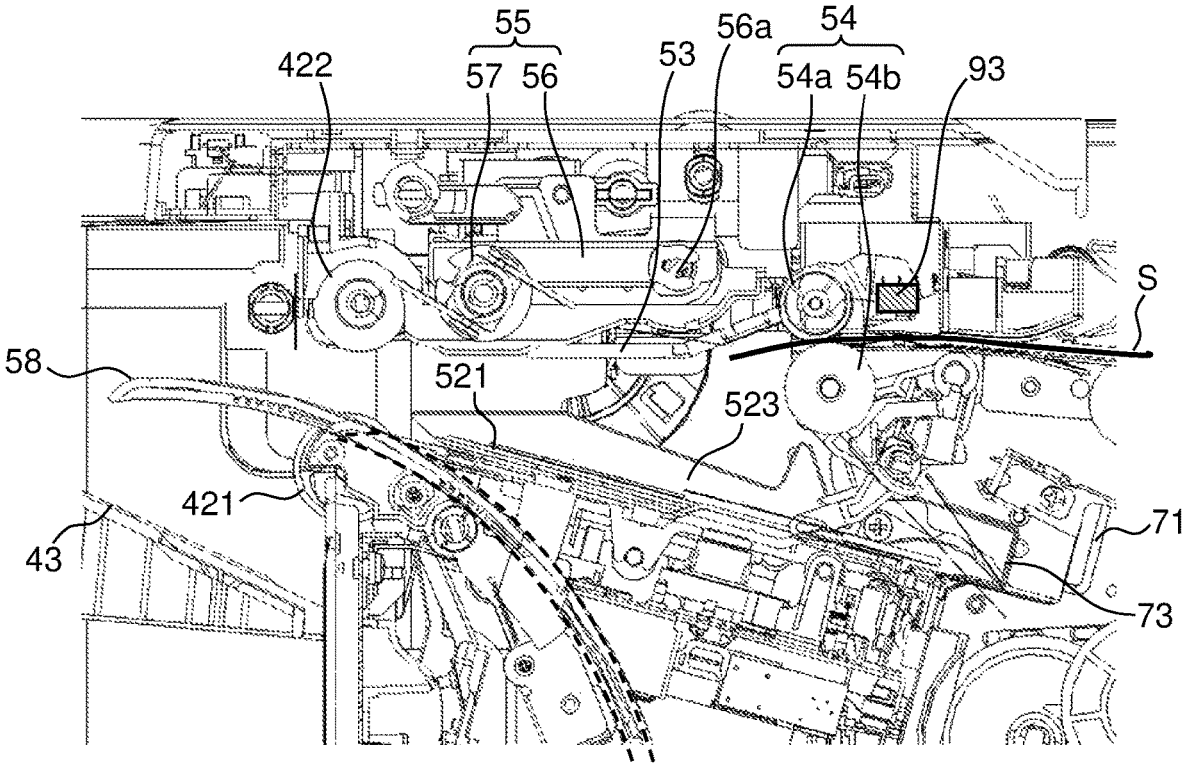
FIG. 5 is a cross-sectional side view of a structure around a processing tray.

FIG. 5 is a cross-sectional side view of a structure around the processing tray 521. As illustrated in FIG. 5, a carry-in roller pair 54 is arranged above the processing tray 521. The carry-in roller pair 54 is constituted by a carry-in upper roller 54*a* and a carry-in lower roller 54*b*.

A sheet detection sensor 93 is arranged near the carry-in roller pair 54. The sheet detection sensor 93 detects timings when the sheets S pass through the carry-in roller pair 54. As the sheet detection sensor 93, for example, a PI (photo-interrupter) sensor including a detection unit constituted by a light emitting portion and a light receiving portion is used.

A tapping member 53 and alignment members 55 are provided on a downstream side relative to the carry-in roller pair 54 in the carry-in direction of the sheets S (left side in FIG. 5). The tapping member 53 is supported in a manner that allows the tapping member 53 to pivot in the carry-in direction of the sheets S. The tapping member 53 pivots downward at a timing when a trailing edge of each of the sheets S passes through the carry-in roller pair 54. In this way, the tapping member 53 taps the sheets S downward to cause the sheets S to be fitted to the processing tray 521.

The alignment members 55 are arranged at a plurality of points (four points in this embodiment) along the sheet width direction (a direction perpendicular to the drawing sheet of FIG. 5). The alignment members 55 move (switch back) the sheets S to be carried in onto the processing tray 521 into an alignment direction in which these sheets S come close to the reference plates 73. In this way, the alignment members 55 assist the alignment of the sheets S. The alignment members 55 each include a paddle holder 56 and an alignment paddle 57.

The paddle holder 56 is supported above the processing tray 521 in a manner that allows the paddle holder 56 to pivot along the carry-in direction of the sheets S. Rotational driving force is input to a pivot shaft 56*a* of the paddle holder 56 by a paddle drive motor (not shown). Rotational driving force in a direction (counterclockwise direction in FIG. 5) in which the sheets S are sent out in the alignment direction is input to the alignment paddle 57 by a drive source such as a motor (not shown). The alignment paddle 57 rotates in abutment against top surfaces of the sheets S to be carried in onto the processing tray 521. In this way, the alignment paddle 57 moves the sheets S in the alignment direction, and causes the edges of the sheets S to be hit against and aligned by the reference plates 73.

The pivot of the paddle holder 56 is controlled on the basis of the timings detected by the sheet detection sensor 93. Specifically, at a timing when the sheet detection sensor 93 detects that the leading edge of each of the sheets S passes through the carry-in roller pair 54, the paddle holder 56 is pivoted upward. As a result, the alignment paddle 57 moves away from an upper surface of the processing tray 521 (or from the top surface of the sheets S stacked on the processing tray 521).

FIG. 5 illustrates a state immediately before a subsequent sheet S is carried in onto the processing tray 521. The paddle holder 56 has pivoted upward (in a clockwise direction), and the alignment paddle 57 has come to a position away from the processing tray 521 (reference position). In addition, a nip between the discharge lower rollers 421 and discharge upper rollers 422 constituting the first discharge-roller pairs 42 is released. With this, the sheet S that has been carried in over the processing tray 521 through the carry-in roller pair 54 once passes through the first discharge-roller pairs 42, and protrudes above the first discharge tray 43.

Then, at a timing when an edge of the subsequent sheet S that has been carried in over the processing tray 521 passes below the alignment paddle 57, the paddle holder 56 is pivoted in a reverse direction (the counterclockwise direction). As a result, the alignment paddle 57 comes to a position at which the alignment paddle 57 comes into contact with a top surface of the sheet S (acting position). The above-described operation is repeated every time the sheets S are carried in. With this, the edges of the sheets S to be carried in onto the processing tray 521 and the alignment paddle 57 can avoid interfering with each other, and the alignment paddle 57 can be reliably brought into contact with the top surfaces of the sheets S.

Support members 58 are arranged under the processing tray 521. The support members 58 are each a bar-like member that has a predetermined width in the sheet width direction and that extends in a circular-arc shape into a discharge direction. The support members 58 are arranged on a lower side in the first discharge port 41. More specifically, the support members 58 are arranged under the processing tray 521 and under a discharge path of the sheets S to be discharged along the processing tray 521 through the first discharge-roller pairs 42. In this embodiment, the support members 58 are arranged at two points in the sheet width direction at a predetermined interval in the sheet width direction relative to the tray central portion 522 of the processing tray 521.

The support members 58 are movable to a protruding position (position represented by a solid line in FIG. 5) at which the support members 58 protrude to a downstream side relative to the first discharge-roller pairs 42 in the discharge direction (left side in FIG. 5), and to a retractive position (position represented by a broken line in FIG. 5) to which the support members 58 retract on an upstream side relative to the first discharge-roller pairs 42 in the discharge direction (right side in FIG. 5). The support members 58 come to the protruding position at a time when the sheets S are carried in (switched back) onto the processing tray 521, and support parts of the sheets S, the parts having protruded above the first discharge tray 43.

[5. Alignment Operation of Sheets in Width Direction on Processing Tray]

Now, an alignment operation of the sheets S in the width direction on the processing tray 521 is described. In this embodiment, a width-direction alignment operation by the width regulating members 523 is performed in two stages onto each of the sheets S.

Figure 6:
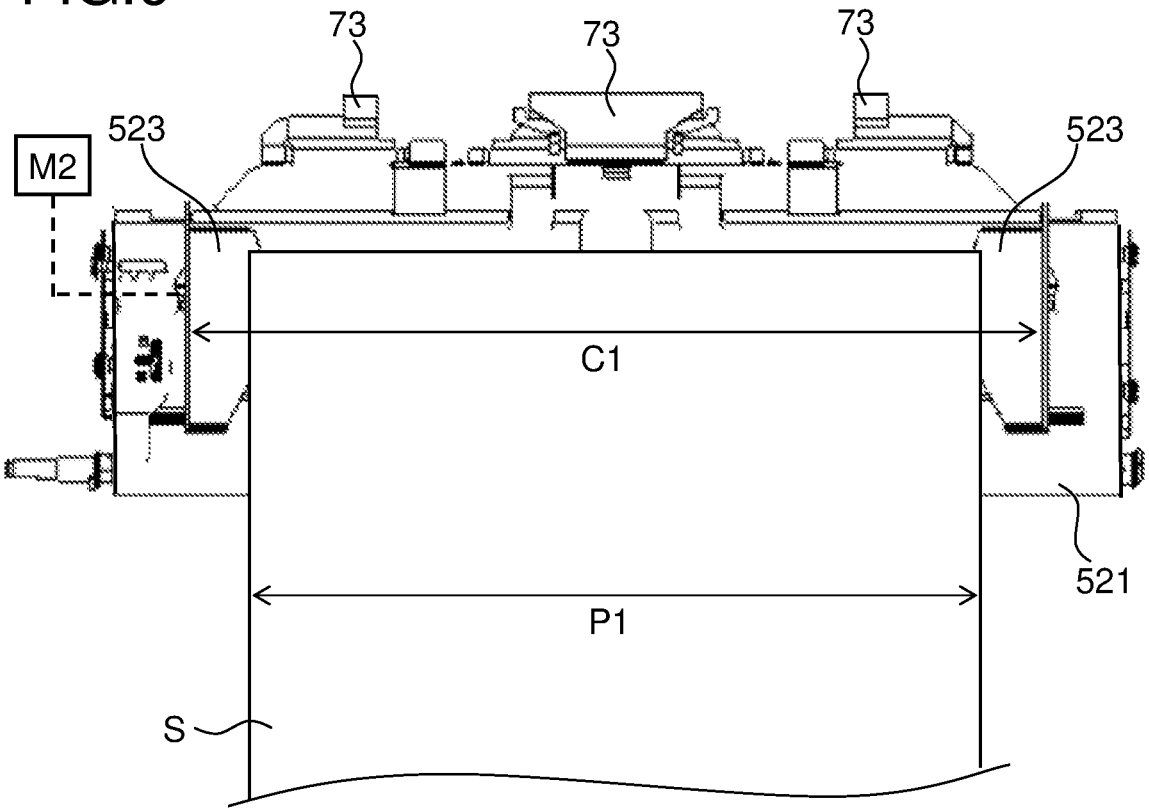
FIG. 6 is a plan view illustrating how a sheet is carried in onto the processing tray, the view illustrating a state in which width regulating members have come to standby positions.

FIG. 6 is a plan view illustrating how the sheet S is carried in onto the processing tray 521. As illustrated in FIG. 6, at the time when the sheet S is carried in onto the processing tray 521, the pair of width regulating members 523 have come to their standby positions (home positions). An interval C1 between the pair of width regulating members 523 at the standby positions is set to be sufficiently larger than a width-direction size (sheet width) P1 of the sheet S.

Figure 7:
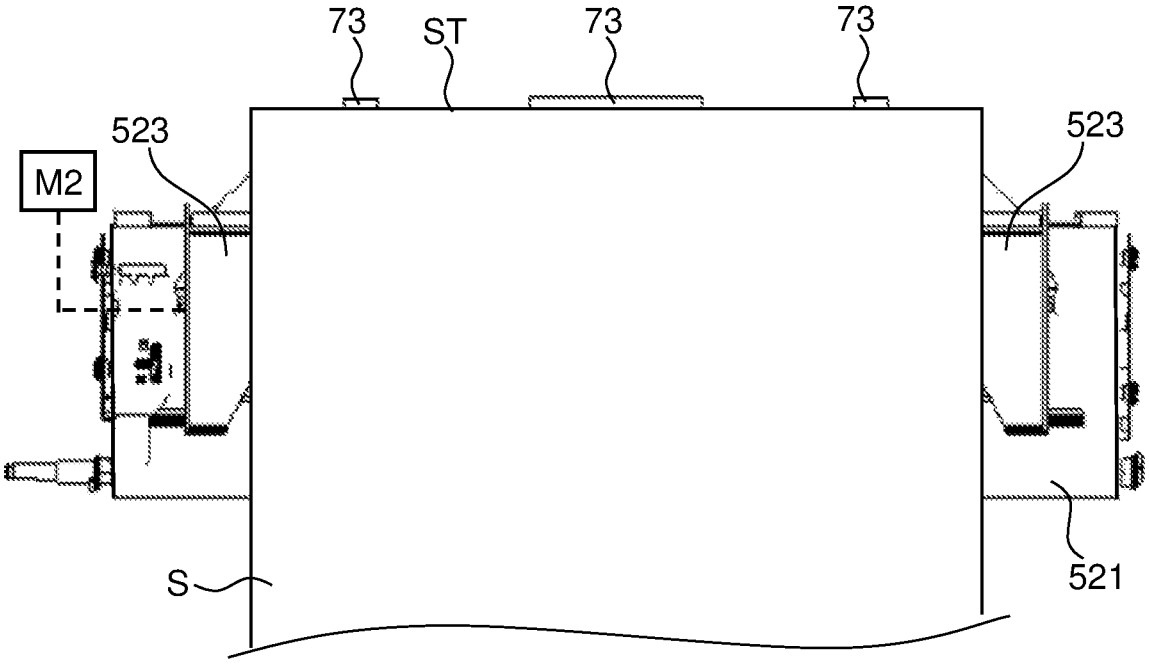
FIG. 7 is a view illustrating a state in which the sheet in the state illustrated in FIG. 6 has been sent in a carry-in direction and aligned in the carry-in direction by reference plates.

When the sheet S in the state illustrated in FIG. 6 is sent further in the carry-in direction, as illustrated in FIG. 7, the edge ST in the carry-in direction of the sheet S is hit against and aligned by the reference plates 73 in the carry-in direction.

Figure 8:
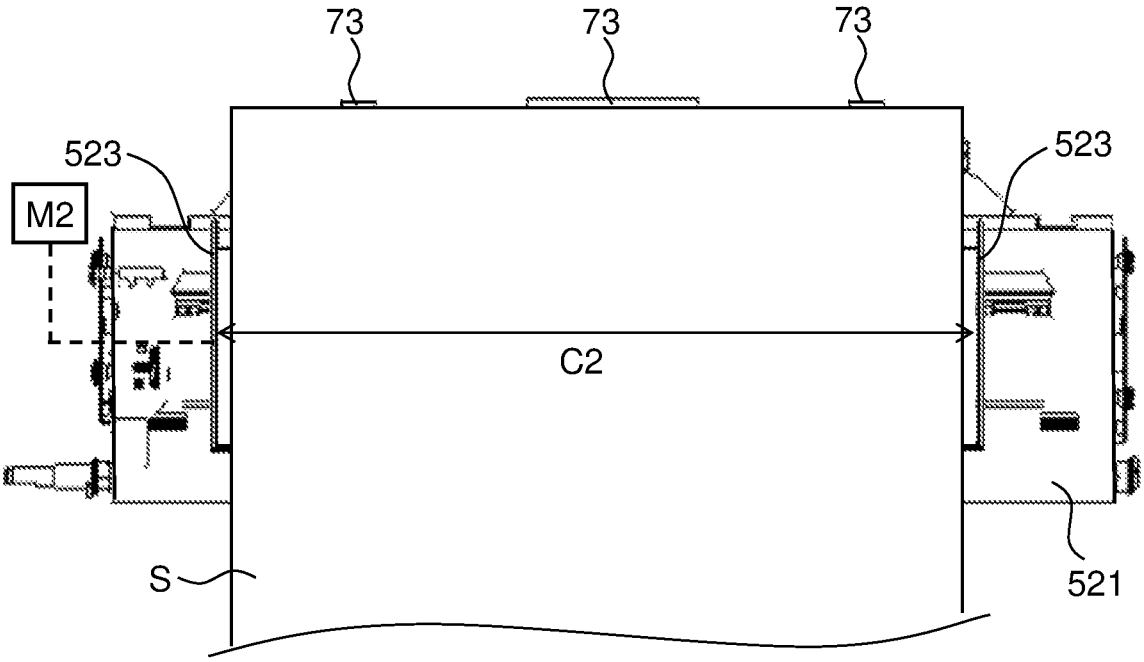
FIG. 8 is a view illustrating a state in which the width regulating members in the state illustrated in FIG. 7 have been moved from the standby positions to first regulating positions.

After the sheet S has been aligned in the carry-in direction, a first stage of the alignment operation (first alignment operation) by the width regulating members 523 is performed. Specifically, the post-processing control portion 10 transmits a control signal to the width-regulating-member drive motor M2 to move, as illustrated in FIG. 8, the width regulating members 523 from the standby positions to first regulating positions on an inner side in the sheet width direction. An interval C2 between the pair of width regulating members 523 at the first regulating positions is set to be somewhat larger than the sheet width P1.

Figure 9:
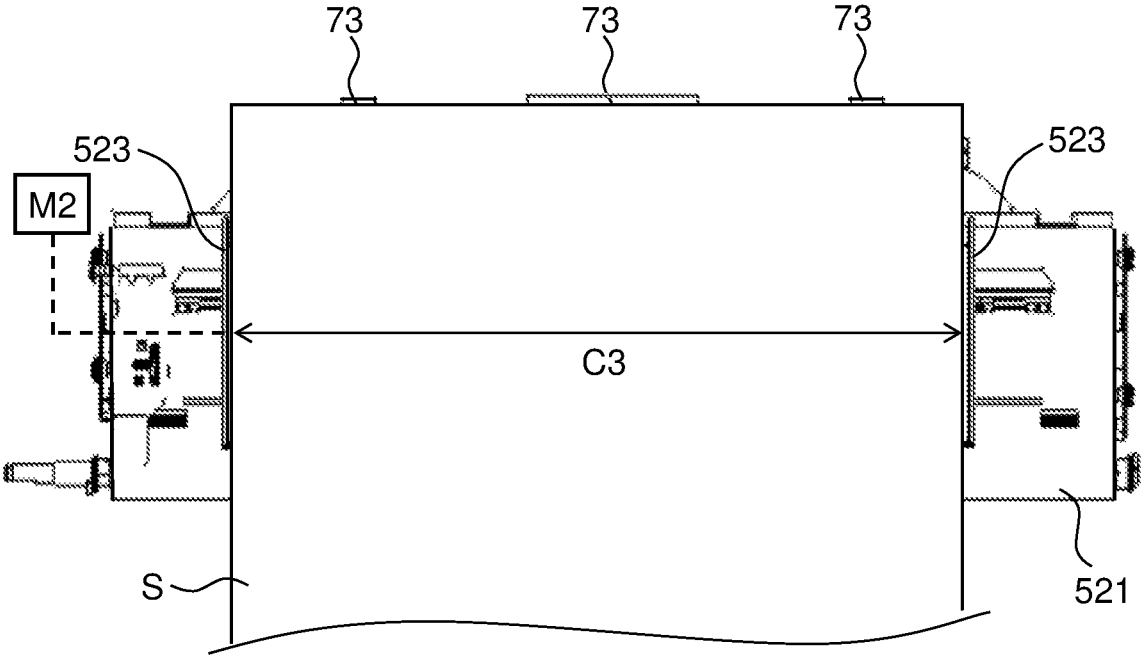
FIG. 9 is a view illustrating a state in which the width regulating members in the state illustrated in FIG. 8 have been moved to second regulating positions after having been once returned to the standby positions.

Next, the width regulating members 523 in the state illustrated in FIG. 8 are once returned to the standby positions, and then a second stage of the alignment operation (second alignment operation) by the width regulating members 523 is performed. Specifically, as illustrated in FIG. 9, the post-processing control portion 10 causes the width regulating members 523 to move to second regulating positions on the inner side in the sheet width direction. An interval C3 between the pair of width regulating members 523 at the second regulating positions is set to be equal to or somewhat smaller than the sheet width P1. The above-described alignment operation is repetitively performed every time each of the sheets S is carried in.

Relationships between the sheet width P1 and the intervals C1, C2, and C3 between the pair of width regulating members 523 at the standby positions, the first regulating positions, and the second regulating positions are summarized into the following formula (1).

$$C1>C2>P1\geq C3 \quad (1)$$

After that, the post-processing control portion 10 causes the stapling unit 71 to move to a predetermined stapling position, and then to execute the stapling process onto the plurality of sheets S that have been aligned by the reference plates 73 and the width regulating members 523. The post-processing control portion 10 causes the first discharge-roller pairs 42 to discharge the bundle of the sheets S that have been subjected to the stapling process onto the first discharge tray 43.

By the above-described configuration, skews of the sheets S are corrected to some extent by the first alignment operation in which the interval between the width regulating members 523 is adjusted to be somewhat larger (C2) than the sheet width P1. Then, the skews of the sheets S are accurately corrected by the second alignment operation in which the interval between the width regulating members 523 is adjusted to be equal to or reduced to be somewhat smaller (C3) than the sheet width P1. With this, the skews of the sheets S at the time when the sheets S are carried in onto the processing tray 521 can be reliably corrected without applying a conveyance load to the sheets S as high as that at a time when the alignment by the width regulating members 523 is performed in a single stage. Thus, even when the image forming apparatus 200 is an ink-jet recording apparatus and the sheets S on which the images have been output do not smoothly slide, the skews of the sheets S can be reliably corrected. With this, the sheets S can be maintained in a good alignment state.

Incidentally, a degree of the skews of the sheets S to be carried in onto the processing tray 521 varies depending on the sizes in the width direction of the sheets S, amounts of inks to be used for image recording, and patterns of images formed by the inks. Specifically, when the size in the width direction of the sheets S is larger than their size in the conveying direction, the degree of the skews of the sheets S tends to increase. In addition, also when the amounts of the inks to be used for the image recording are large, or when the patterns of the images formed by the inks are printed largely on one side in the width direction, the degree of the skews of the sheets S tends to increase. Thus, it may be difficult to stably correct the skews of the sheets S and to align the sheets S only by setting an interval C2-P1 between the width regulating members 523 and the sheets S in the first alignment operation to be uniform.

As a countermeasure, in this embodiment, the interval C2-P1 between the width regulating members 523 and the sheets S at the time when the sheets S are aligned in the width direction by the first alignment operation is adjusted on the basis of output information about properties of the sheets S (the sizes, the amounts of the inks, and the patterns of the images). Specifically, the output information about the properties of the sheets S is input from the image forming apparatus 200. In accordance with the input output information about the properties of the sheets S, the post-processing control portion 10 adjusts the interval C2-P1 between the width regulating members 523 and the sheets S in the first alignment operation.

Figure 10:
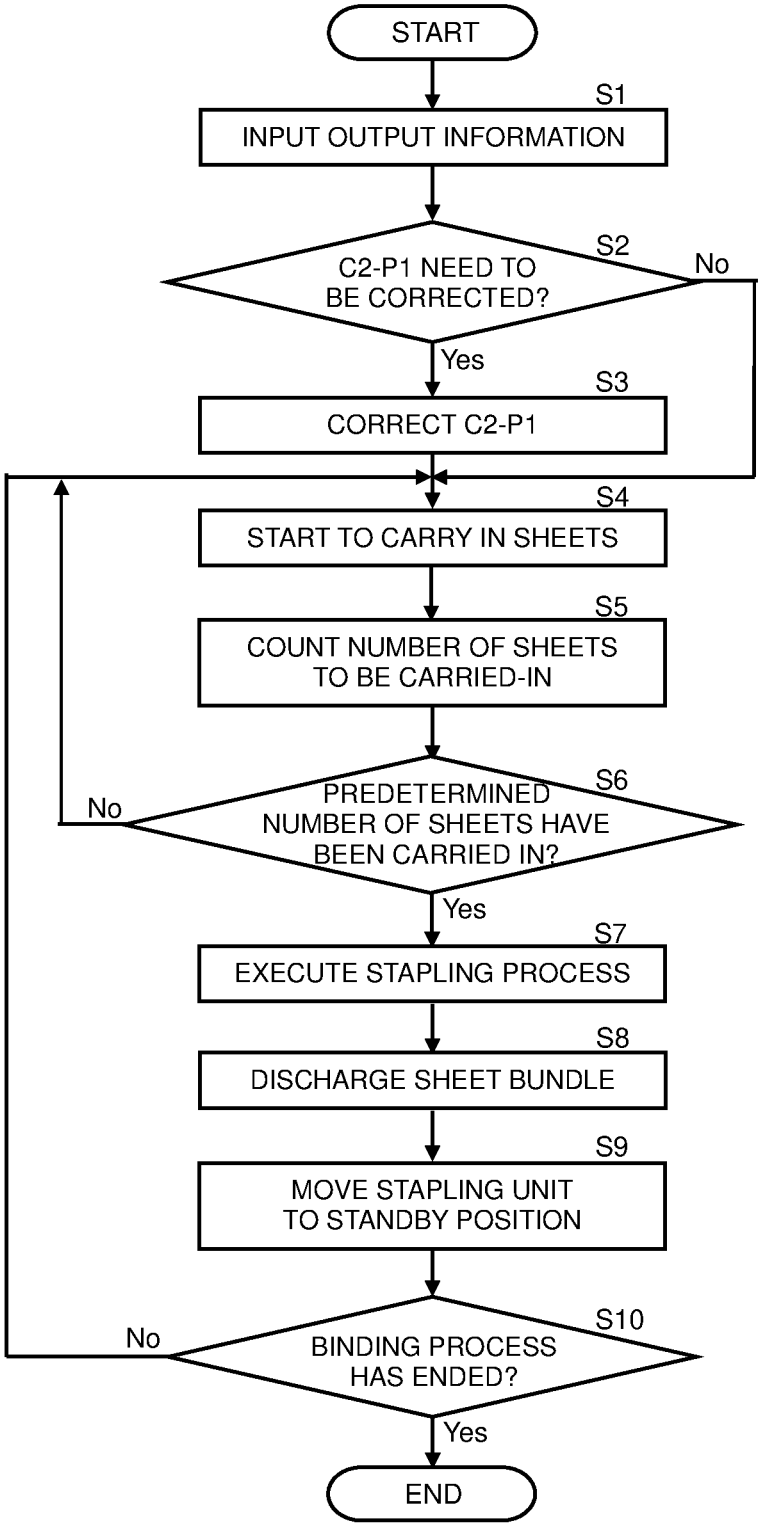
FIG. 10 is a flowchart showing an example of controlling adjustment of the positions at which the sheet is regulated by the width regulating members in the sheet post-processing apparatus according to the embodiment.

FIG. 10 is a flowchart showing an example of controlling the adjustment of the positions at which the sheets S are regulated by the width regulating members 523 in the sheet post-processing apparatus 1 according to this embodiment. Referring back to FIG. 1 to FIG. 9 when necessary, a procedure of adjustment of the acting position of the alignment paddle 57 is described sequentially with reference to Steps in FIG. 10. Note that, in an initial state, the interval C2-P1 between the width regulating members 523 and the sheets S in the first alignment operation is set as a reference interval (such as an interval corresponding to the most-frequently-used information among the output information) In addition, in the following description, the output information about the properties of the sheets S is simply referred to also as "output information about the sheets S."

When a command to execute the binding process onto the sheets S is input from the main body control portion 203 in the image forming apparatus 200, the output information about the sheets S is input together with the command to execute the binding process (Step S1). Among the output information about the sheets S, information about the sizes of the sheets S is input via the operation panel 202 of the image forming apparatus 200. Specifically, a manufacturer, a trade name, a product number, and so on may be associated with the information about the sizes of corresponding sheets S, and stored in advance in the main body control portion 203. With this, only by selection of the manufacturer, the trade name, the product number, and so on of the sheets S by a user via the operation panel 202, the main body control portion 203 can recognize the sizes of the sheets S to be used.

As for information about the amounts of the inks and the patterns of the images, the main body control portion 203 calculates amounts of inks and patterns of images to be used for the image recording on the basis of image data to be transmitted from a host apparatus such as a personal computer or from the image reading unit 201. In this way, the information about the amounts of the inks and the patterns of the images are generated by the main body control portion 203, and then transmitted therefrom.

On the basis of the input information about the sizes of the sheets S, the amounts of the inks, and the patterns of the images, the post-processing control portion 10 determines whether or not the positions at which the sheets S are regulated by the width regulating members 523 need to be corrected (Step S2). If the post-processing control portion 10 determines that the regulating positions need to be corrected (Yes in Step S2), the post-processing control portion 10 corrects the interval C2-P1 between the width regulating members 523 and the sheets S in the first alignment operation relative to the reference interval (Step S3).

For example, when the size in the width direction of the sheets S is larger than their size in the conveying direction, the sheets S are liable to be skewed. As a countermeasure, the interval C2-P1 between the width regulating members 523 and the sheets S in the first alignment operation is corrected to be larger than the reference interval. In addition, also when the amounts of the inks are larger than predetermined amounts, or when the patterns of the images are printed largely on one side in the width direction, the sheets S are liable to be skewed. As a countermeasure, the interval C2-P1 between the width regulating members 523 and the sheets S in the first alignment operation is corrected to be larger than the reference interval. An amount of the correction relative to the reference interval is determined on the basis of a correction table that associates the sizes of the sheets S, the amounts of the inks, the patterns of the images, and the intervals C2-P1 corresponding to the sizes, the amounts, and the patterns with each other.

If the post-processing control portion 10 determines that the interval C2-P1 need not be corrected (No in Step S2), the post-processing control portion 10 advances the procedure to subsequent Steps without changing the interval C2-P1 relative to the reference interval.

Next, the post-processing control portion 10 starts to carry in the sheets S onto the processing tray 521 (Step S4), the sheets S having been carried into the sheet post-processing apparatus 1 through the sheet carry-in port 2. Specifically, after the sheet detection sensor 93 has detected that a trailing edge of the sheet S passes through the carry-in roller pair 54, the post-processing control portion 10 (refer to FIG. 2) causes the tapping member 53 to tap the trailing edge of the sheet S so that the sheet S is fitted to the processing tray 521. Then, the post-processing control portion 10 causes the paddle holder 56 to lower by a predetermined amount. With this, the alignment paddle 57 is move to the acting position, and comes into contact with the top surface of the sheet S. In this state, the alignment paddle 57 is rotated to cause the sheet S to be drawn in the alignment direction (direction of the arrow B) along the processing tray 521.

After that, the sheet S is sent further to the downstream side in the alignment direction by the alignment paddle 57, and stacked while aligned in the sheet width direction by the width regulating members 523 (refer to FIG. 3), and while aligned in the carry-in direction by the reference plates 73. As illustrated in FIG. 6 to FIG. 9, the alignment in the sheet width direction by the width regulating members 523 is performed in the two stages of the first alignment operation and the second alignment operation.

The post-processing control portion 10 counts the number of the sheets S to be carried in onto the processing tray 521 (Step S5). Then, the post-processing control portion 10 determines whether or not a predetermined number of the sheets S have been carried in onto the processing tray 521 (Step S6). If the predetermined number of the sheets S have not yet been carried in (No in Step S6), the procedure is returned to Step S5, and the carrying-in of the sheets S onto the processing tray 521, the alignment of the carried-in sheets S, and the count of the sheets S to be carried in are repeated.

If the predetermined number of the sheets S have been carried in (Yes in Step S6), the post-processing control portion 10 transmits a control signal to the stapling-unit drive motor M1 (refer to FIG. 3) to cause the stapling unit 71 to move to the predetermined stapling position. After the stapling unit 71 has moved to the predetermined stapling position, the post-processing control portion 10 transmits a control signal to the stapling unit 71 to cause the stapling unit 71 to execute the stapling process onto the plurality of sheets S that have been aligned by the reference plates 73 (Step S7).

Next, the post-processing control portion 10 causes the first discharge rollers 42 to be held in contact in pairs with each other (to form a nip therebetween), and causes these first discharge-roller pairs 42 to rotate in the discharge direction. With this, the bundle of the sheets S that have been subjected to the stapling process is discharged onto the first discharge tray 43 by the first discharge-roller pairs 42 (both illustrated in FIG. 2) (Step S8). After the bundle of the sheets S has been discharged, the post-processing control portion 10 transmits a control signal to the stapling-unit drive motor M1 to cause the stapling unit 71 to move to its standby position (Step S9).

After that, the post-processing control portion 10 determines whether or not the binding process has ended (Step S10). If the binding process has still continued (No in Step S10), the procedure is returned to Step S4, and the carrying-in of the sheets S onto the processing tray 521, the alignment of the carried-in sheets S, the count of the sheets S to be carried in, the execution of the stapling process, the discharge of the sheet bundle, the movement of the stapling unit 71 to the standby position are repeated (Steps S4 to S10). If the binding process has ended (Yes in Step S10), the procedure is ended.

In the example of the control shown in FIG. 10, the interval C2-P1 between the width regulating members 523 and the sheets S in the first alignment operation is corrected to an optimum interval on the basis of the sizes of the sheets S, the amounts of the inks, and the patterns of the images. Thus, the sheets S can be stably aligned in the width direction without influence of the sizes of the sheets S, the amounts of the inks, and the patterns of the images.

The scope of the present disclosure is not limited to the embodiment described hereinabove, and may be embodied with various modifications without departing from the gist of the present disclosure. For example, the post-processing control portion 10 need not necessarily be configured to automatically correct the interval C2-P1 at the first regulating positions on the basis of the output information about the sheets S as in the above-described embodiment, and the user may be allowed to correct the interval C2-P1 at the first regulating positions at arbitrary timings. Specifically, it is conceivable that an alignment-level adjustment mode for switching the interval C2-P1 at the first regulating positions is provided to the operation panel 202 so that the user can select modes in accordance with a status (alignment level) of the stapling process in the sheet binding unit 92.

Further, the present disclosure is not limited to the example described above in the embodiment in which the sheet binding unit 92 executes the binding process onto the sheets S stacked on the processing tray 521. A configuration in which not only the folding process but also a shift discharge process is executed onto the sheets S stacked on the processing tray 521 may be employed.

Still further, the size information of the sheets S need not necessarily be input via the operation panel 202 of the image forming apparatus 200 as in the above-described embodiment, and the size information of the sheets S and the amounts of the inks may be automatically acquired. For example, a sheet-size detection sensor may be arranged at an arbitrary position in a sheet conveying path from the image forming apparatus 200 to the sheet post-processing apparatus 1 so that the sizes of the sheets S to be carried from the image forming apparatus 200 into the sheet post-processing apparatus 1 can be detected. For example, the PI (photo-interrupter) sensor including a detection unit constituted by a light emitting portion and a light receiving portion is used as the sheet-size detection sensor.

Yet further, a moisture meter that detects water content of the sheets S may be used to detect the amounts of the inks on the sheets S.

Yet further, the image forming apparatus 200 need not necessarily be an ink-jet recording apparatus as exemplified in the above-described embodiment, and an electrophotographic printer or an electrophotographic copying machine may be used as the image forming apparatus 200. Note that, in the ink-jet recording system that ejects inks onto the sheets S, the conveyance load on the sheets S is more liable to vary than in the electrophotographic system. Thus, the present disclosure is particularly useful as the sheet post-processing apparatus 1 to which the image forming apparatus 200 being an ink-jet recording apparatus is joined.

The present disclosure is applicable to sheet post-processing apparatuses that execute predetermined post processes onto a plurality of sheets.

What is claimed is:

1. A sheet post-processing apparatus, comprising:

a conveying member which is configured to convey a sheet, the sheet including a plurality of sheets;

a processing tray on which the plurality of sheets that are carried in along a predetermined carry-in direction by the conveying member are stacked;

a processing unit which is configured to execute a predetermined post process onto the plurality of sheets that are stacked on the processing tray;

a reference plate which is configured to align the plurality of sheets in the predetermined carry-in direction by abutting against edges of the plurality of sheets, the plurality of sheets being carried in onto the processing tray, the edges being on a downstream side in an alignment direction that is opposite to the predetermined carry-in direction;

a pair of width regulating members which are configured to reciprocate in a width direction that is orthogonal to the predetermined carry-in direction, and which are configured to align the plurality of sheets that are carried in onto the processing tray in the width direction;

a drive unit which is configured to reciprocate the pair of width regulating members; and a control portion which is configured to control the drive unit, the control portion repetitively performing a width-direction alignment operation every time each of the plurality of sheets is carried in onto the processing tray, the width-direction alignment operation including a first alignment operation of moving the pair of width regulating members from standby positions to first regulating positions after each of the plurality of sheets that are carried in onto the processing tray has been aligned in the predetermined carry-in direction by the abutting of the edge of each of the plurality of sheets against the reference plate, and a second alignment operation of moving the pair of width regulating members from the first regulating positions to the standby positions after performing the first alignment operation, and then moving the pair of width regulating members to second regulating positions, the sheet post-processing apparatus satisfying the following formula (1)

$$C1>C2>P1\geq C3 \quad (1)$$

where

P1 is a size in the width direction of each of the plurality of sheets,

C1 is an interval between the pair of width regulating members at the standby positions, C2 is an interval between the pair of width regulating members at the first regulating positions, and C3 is an interval between the pair of width regulating members at the second regulating positions.

2. The sheet post-processing apparatus according to claim 1, wherein the control portion is capable of adjusting an interval between the pair of width regulating members and each of the plurality of sheets at the first regulating positions.

3. The sheet post-processing apparatus according to claim 2, wherein the control portion increases the interval between the pair of width regulating members and each of the plurality of sheets at the first regulating positions by adjusting the first regulating positions as a degree of skews of the plurality of sheets becomes larger.

4. The sheet post-processing apparatus according to claim 3, wherein the control portion adjusts the interval between the pair of width regulating members and each of the plurality of sheets at the first regulating positions on a basis of a size in the width direction of each of the plurality of sheets and a size in the predetermined carry-in direction of each of the plurality of sheets.

5. The sheet post-processing apparatus according to claim 1, wherein the processing unit is a stapling unit that is configured to execute a stapling process of stapling a predetermined point on the plurality of sheets that have been stacked on the processing tray.

6. An image forming system, comprising:

an image forming apparatus that is configured to form an image onto a sheet; and the sheet post-processing apparatus according to claim 1, the sheet post-processing apparatus being configured to execute the predetermined post process onto the sheet on which the image has been formed by the image forming apparatus.

7. An image forming system, comprising:

an image forming apparatus that is configured to form an image onto a sheet; and the sheet post-processing apparatus according to claim 3, the sheet post-processing apparatus being configured to execute the predetermined post process onto the sheet on which the image has been formed by the image forming apparatus, the image forming apparatus being an ink-jet recording apparatus that is configured to record the image by ejecting an ink onto the sheet, the control portion adjusting an interval between the pair of width regulating members and the sheet at the first regulating positions on a basis of an amount of the ink to be used for recording the image onto the sheet and a pattern of the image recorded with use of the ink.

8. An image forming system, comprising:

an image forming apparatus that is configured to form an image onto a sheet; and the sheet post-processing apparatus according to claim 4, the sheet post-processing apparatus being configured to execute the predetermined post process onto the sheet on which the image has been formed by the image forming apparatus, the image forming system further including an input unit to which a size in the width direction of the sheet and a size in the predetermined carry-in direction of the sheet are input.

9. The image forming system according to claim 8, wherein an interval between the pair of width regulating members and the sheet at the first regulating positions can be adjusted in response to an input operation to the input unit.

* * * * *